US005362071A

United States Patent [19]

Liu

[11] Patent Number: 5,362,071

[45] Date of Patent: Nov. 8, 1994

[54] PROTECTIVE CASING FOR A RACKET FRAME

[76] Inventor: Leueis Liu, 9F-3, No. 218, Kuo Kuang Rd., Taichung, Taiwan, Prov. of China

[21] Appl. No.: 127,070

[22] Filed: Sep. 27, 1993

[51] Int. Cl.[5] ..... A63B 49/14

[52] U.S. Cl. ..... 273/73 D

[58] Field of Search ..... 273/73 R, 73 C, 73 D

[56] References Cited

U.S. PATENT DOCUMENTS

| | | | |
|---|---|---|---|
| 4,776,592 | 10/1988 | Umlauft et al. | 273/73 D |
| 4,786,055 | 11/1988 | Darling | 273/73 D |
| 4,836,543 | 6/1989 | Holzer | 273/73 D X |
| 4,889,337 | 12/1989 | Todd | 273/73 D |
| 5,102,132 | 4/1992 | Chen | 273/73 D X |

FOREIGN PATENT DOCUMENTS

| | | | |
|---|---|---|---|
| 2187392 | 9/1987 | United Kingdom | 273/73 D |

*Primary Examiner*—William E. Stoll

*Attorney, Agent, or Firm*—Morton J. Rosenberg; David I. Klein

[57] ABSTRACT

A protective casing for a game racket comprises a long groove, a plurality of string-protection pipes, two floating plates extending from two sides of the groove and having a plurality of predetermined through insert holes; and a plurality of insert elements can embed in the corresponding insert holes so that the top of each insert element protrudes over the top surfaces of the floating portions in order to protect the protective plates of the protective casing.

6 Claims, 4 Drawing Sheets

PROTECTIVE CASING FOR A RACKET FRAME

BACKGROUND OF THE INVENTION

The present invention is related to a protective casing for a game racket which can protect a racket frame more effectively.

In the applicant's patent application (U.S. Ser. No. 07/966,554), a plurality of floating plates (82) are located on the protective plates (81) of the protective casing (8). There is a predetermined space between said floating plates' (82) inner walls and the racket frame's (9) outer wall (91). Said floating plates (82) have connecting plates (83) which can connect with said protective plates (81) and form a predetermined space between said floating plates (82) and said protective plates (81). Therefore, said protective plates (81) provide a better buffer effect for collision. But, if there are too many collisions on the racket frame, said floating plates (82) still will be worn down or broken eventually.

SUMMARY OF THE INVENTION

The main purpose of present invention is to solve the problem mentioned above. The structure not only can provide an effective protective casing for a game racket, but also can prolong the life of the protective casing itself.

The present invention provide a protective casing for a game racket. The protective casing comprises a long groove from one end to the other end of said casing. Said groove has a plurality of string holes for stringing the racket's striking network. Around the string holes, a plurality of string-protection pipes is extended from the peripheries of corresponding string holes and further extended through the groove bottom with certain length over said groove's convex side. In the two sides of said groove, the protective plates are extended according to the shape of said racket frame's outer wall. The major improvement comprises as follows: said protective plates have a plurality of predetermined floating portions. A plurality of insert holes with prescribed geometry is on the top of said floating portions. A plurality of insert elements is embedded in said insert holes accordingly. Also, the top portions of said insert elements are protruded over the top surfaces of said floating portions.

BRIEF DESCRIPTION OF THE DRAWINGS

The attached drawings illustrate the preferred embodiments of the present invention as follows.

DETAILED DESCRIPTION OF THE PREFERRED EMBODIMENT

Figure 1:
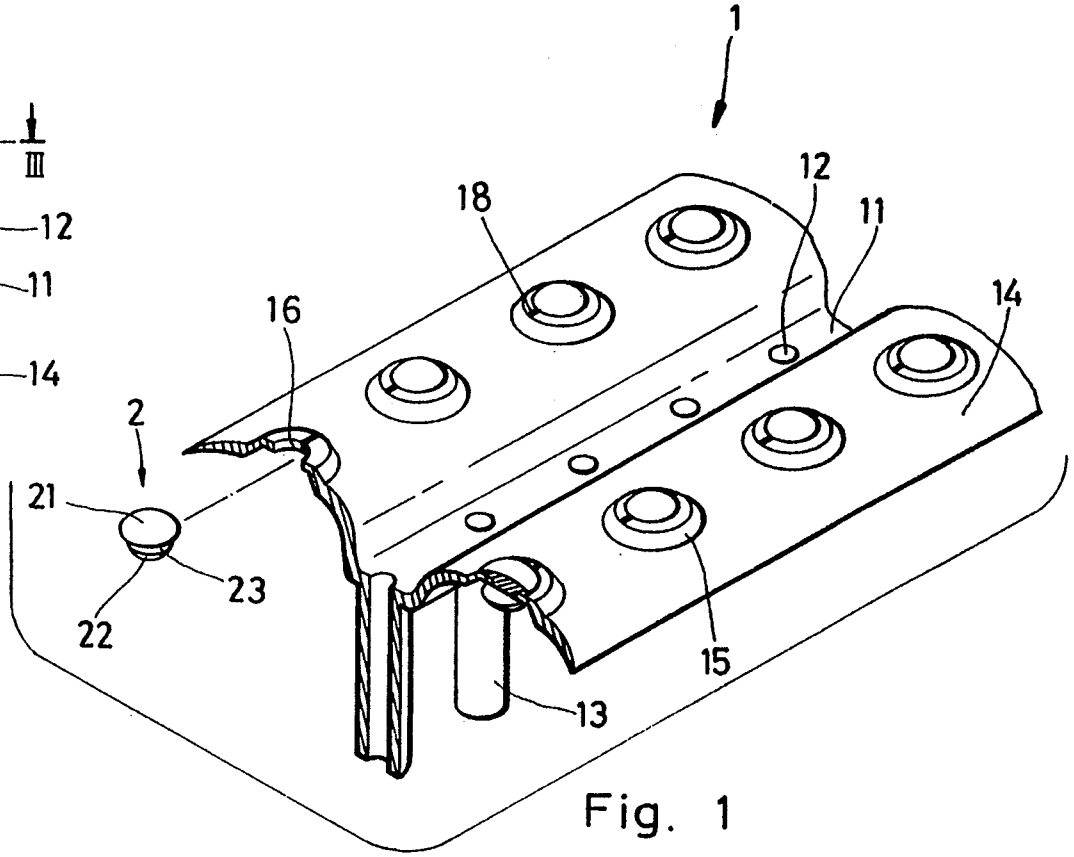
FIG. 1 is a perspective view of the first preferred embodiment of the present invention.
Figure 2:
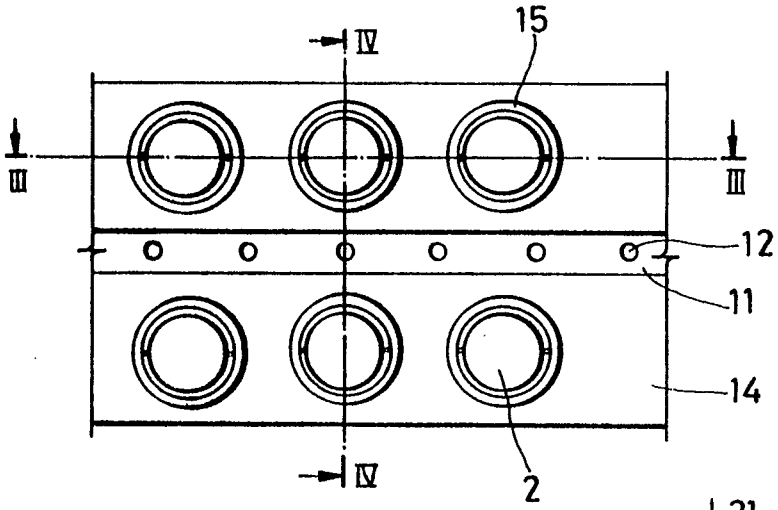
FIG. 2 is a top view of the first preferred embodiment.

Referring to FIGS. 1–4 the protective casing (1) for a game racket of the present invention comprises: a long groove (11) from one end to the other end of said protective casing (1); a plurality of string holes (12) on said groove (11) for stringing the racket's striking network; a plurality of string-protection pipes (13) extended from the peripheries of said corresponding string holes (12) and further extended through the groove (11) bottom with certain length over said groove's (11) convex side; in the two sides of said groove (11), two protective plates (14) extended according to the shape of said racket frame's outer wall; a plurality of predetermined floating portions (15) on said protective plates (14) so that a buffer space (17) is generated inside said floating portions (15); a plurality of circular insert holes (16) with prescribed geometry locating on and passing through the tops of said floating portions (15); on the tops of said floating portions, a plurality of gutters (18) which is through the tops and parallel to the outer edges of said protective plates (14) and passing through said holes' (16) centers for the convenience of replacing insert elements (2); and a plurality of insert elements (2) embedded in said insert holes of floating portions accordingly.

Figure 3:
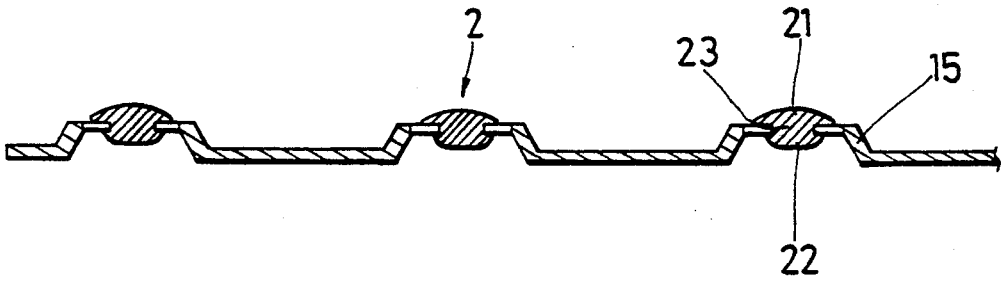
FIG. 3 is a sectional view along the III—III line.
Figure 4:
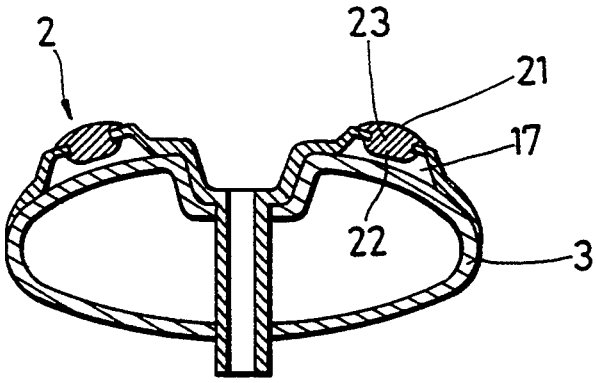
FIG. 4 is a sectional view along the IV—IV line (In which, the present invention has already been installed on the racket frame)

Moreover, referring to FIGS. 3 and 4, each insert element (2) is made of plastic material and includes a semi-spherical top portion (21), a semi-spherical bottom portion (22), and a neck-like middle portion (23) in the middle; such that said insert element (2) can be embedded and then form said buffer space (17) beneath said bottom portion (22) inside said floating portion (15). Said middle portion (23) is embedded in said insert hole (16). The top portion (21) of said insert element (2) is protruded over the top surface of said floating portion.

When the racket frame (3) hits the ground or strikes something, said insert elements (2) mentioned above become a first protection layer for said protective casing (1) of the racket frame (3). Said top portions (21) of the insert elements (2) embedded in said floating portions (15) will touch some object first and to protect the protective plates (14) of said protective casing (1). Furthermore, this will reduce the possibility of the wearing or breakage of said protective casing (1). So, the present invention prolongs the life of said protective casing (1) and the life of racket. The function of said gutters (18) on the tops of said floating plates is to make the replacement of said insert elements (2) more convenient, especially when said insert elements (2) are worn down or broken.

Figure 5:
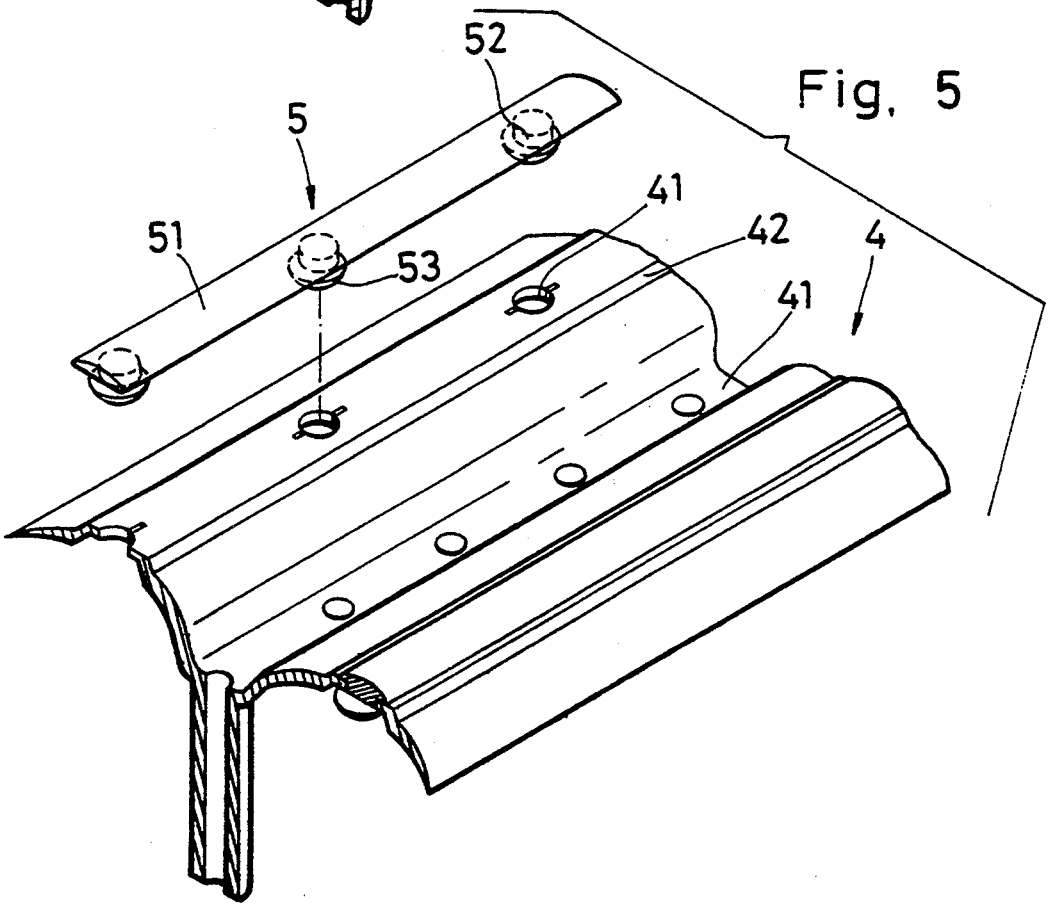
FIG. 5 is a perspective view of the second preferred embodiment of the present invention.
Figure 7:
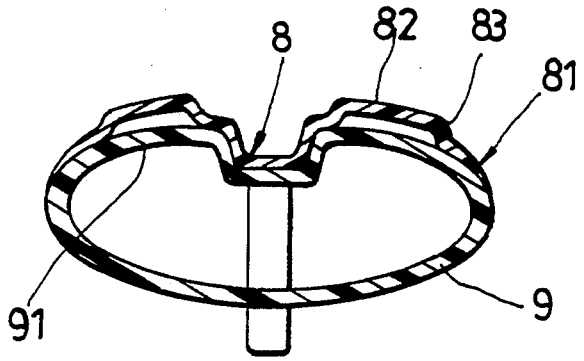
F I G. 7 PRIOR ART
FIG. 7 is a sectional view of the cited prior art.

Said floating portions and said insert elements of the present invention can be any other possible geometries to enhance the ornamentation effects. Please refer to the FIG. 5, the geometry of said floating portions (42) is long plate-like and is parallel to the groove (41) of said protective casing (4) from one end to the other end of said groove (41). On the tops of said floating portions (42), there is a plurality of circular through insert holes (41). Said insert elements' (5) strip-like top portions (51) are extended along the center line of said insert holes (41). The middle portions (52) are circular neck-like cylinders and are disposed with equally space. Said middle portions (52) are embedded in said floating portions (42). Said bottom portion (53) of said insert elements (5) are semi-spherical.

Figure 6:
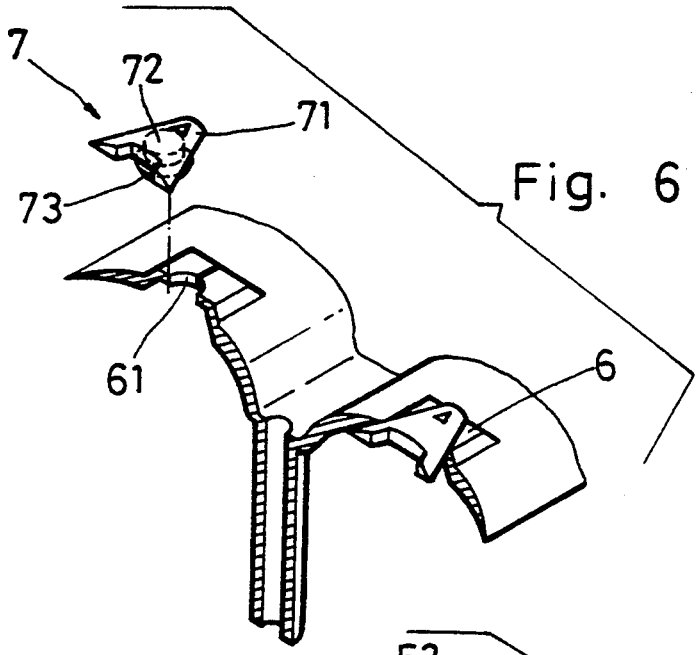
FIG. 6 is a perspective view of the third preferred embodiment of the present invention.

In addition, please refer to the preferred embodiment in FIG. 6. The floating portions (6) are rectangular plate-like. On the top of each floating portion (6), there is a circular through insert hole (61). So the corresponding insert element (7) can be embedded into said insert hole (61). Said top portion (71) of said insert element (7) is a A-shaped plate. The middle portion (72) of said insert element (7) is a cylinder and can be embedded in said floating portion (6) firmly; so that the top portion (71) protrudes over the top surface of said floating portion (6). The bottom portion (73) is semi-spherical.

I claim:

1. A protective casing for a game racket comprising:

a groove extending throughout the length of said protective casing; a plurality of string holes formed in a bottom surface of said groove for stringing the racket's striking network; a plurality of string-protection pipes extended from the peripheries of said corresponding string holes and further extended from the groove bottom surface by a predetermined distance from a convex surface of said groove; a pair of protective plates extended from opposing sides of said groove according to the shape of a racket frame's outer wall;

wherein said protective casing is characterized by: said protective plates further comprising a plurality of truncated conical floating portions having a plurality of circular insert holes of predetermined contour located within and passing through the top of said floating portions; and a plurality of insert elements embedded in said insert holes of said floating portions.

2. The protective casing for a game racket of claim 1, wherein said floating portions have a truncated conical contour and have corresponding circular through holes formed through a top surface; each of said insert elements including a semi-spherical top portion, a semi-spherical bottom portion, and a middle portion whereby said insert elements are embedded in said floating portion whereby the top portion of said insert elements protrude over the top surface of said floating plates.

3. The protective casing for a game racket of claim 1, wherein said protective plates are extended from one end to the other end of said groove and are parallel to said groove; said floating portions having a plurality of insert holes for embedding said insert elements; and each of said insert elements including a top portion along said insert holes, a plurality of middle portions which can be embedded respectively in said insert holes, and a plurality of semi-spherical bottom portions.

4. The protective casing for a game racket of claim 1, wherein said insert elements have top portions having a predetermined contour, a neck-like middle portion, and a semi-spherical bottom portion.

5. The protective casing for a game racket of claim 6, wherein said floating portions have a plurality of extended gutters located on the top of said floating portions and extending parallel to the outer edges of said floating plates.

6. A protective casing for a game racket comprising:

a pair of longitudinally extending protective plates being joined each to the other forming a centrally located longitudinally extending groove portion therebetween;

said groove portion having a plurality of string holes formed therethrough for stringing the racket's striking network;

a plurality of string-protection pipes of predetermined length fixedly coupled and extending from the peripheries of said string holes toward an internal wall of a game racket;

said protective plates further including a plurality of predetermined rectangular plate-like floating portions having a plurality of circular insert holes of predetermined contour passing therethrough; and, a plurality of insert elements embedded in respective ones of said insert holes of said floating portions.

* * * * *